United States Patent [19]

Anderson et al.

[11] Patent Number: 5,050,806

[45] Date of Patent: Sep. 24, 1991

[54] FLOW CONTROL APPARATUS

[75] Inventors: David A. Anderson, Lakewood; Lowell T. Whitney, Arvada; David C. Young, Westminster, all of Colo.

[73] Assignee: Golden Technologies Company, Inc., Golden, Colo.

[21] Appl. No.: 450,739

[22] Filed: Dec. 14, 1989

[51] Int. Cl.[5] ..... B67D 5/60

[52] U.S. Cl. ..... 222/464; 222/529; 222/465.1

[58] Field of Search ..... 222/173, 185, 564, 529, 222/568, 505, 556, 545, 394, 464, 527; 138/42, 44; 239/461

[56] References Cited

U.S. PATENT DOCUMENTS

| | | | |
|---|---|---|---|
| 353,723 | 12/1886 | Weatherhead | 222/173 |
| 2,899,170 | 8/1959 | Cornelius . | |
| 2,924,238 | 2/1960 | Cornelius . | |
| 3,410,456 | 11/1968 | Johnson, Jr. et al. . | |
| 3,592,351 | 7/1971 | Johnson, Jr. . | |
| 3,823,848 | 7/1974 | Schuster et al. . | |
| 3,863,673 | 2/1975 | Sitton . | |
| 4,000,829 | 1/1977 | Johnson, Jr. et al. . | |
| 4,078,578 | 3/1978 | Buchholz . | |
| 4,137,930 | 2/1979 | Scholle . | |
| 4,353,488 | 10/1982 | Schneiter et al. . | |
| 4,569,464 | 2/1986 | Wassilieff | 222/529 |
| 4,739,901 | 4/1988 | Dorfman et al. . | |

*Primary Examiner*—Andres Kashnikow
*Assistant Examiner*—Lesley Morris
*Attorney, Agent, or Firm*—Klaas & Law

[57] ABSTRACT

Flow control apparatus is provided for reducing the pressure on a liquid as it flows from a container where it is maintained at a relatively high pressure to a dispensing valve member where the liquid is dispensed at a relatively low pressure wherein the flow control apparatus comprises a hollow housing, a hollow core member and a flow regulator which are assembled to be in a relatively fixed relationship and to provide a gradually increasing cross-sectional area between the flow regulator and the hollow core member and the hollow housing to reduce the pressure on the liquid. Also, closure members are disclosed and have displaceable sealing portions that may be displaced by a displacing member when attaching a dispensing valve to the container so that the liquid may be displaced from the container.

10 Claims, 5 Drawing Sheets

FIG. 5
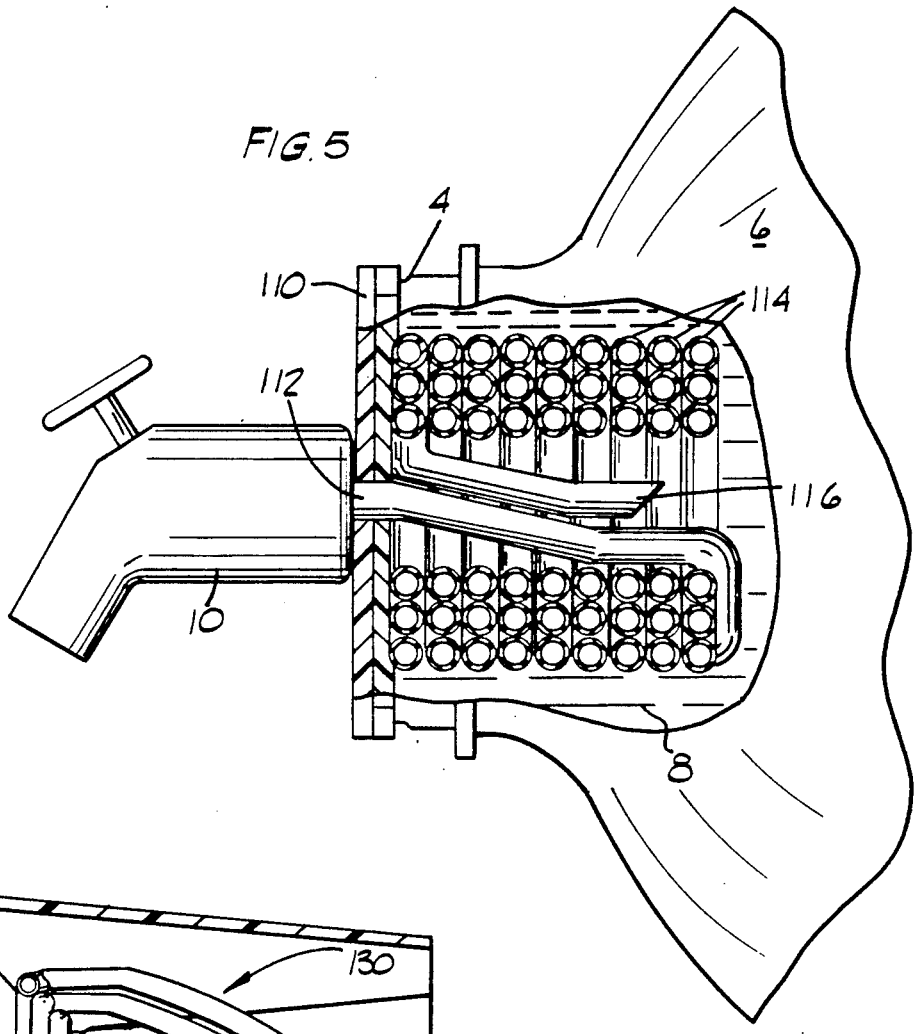
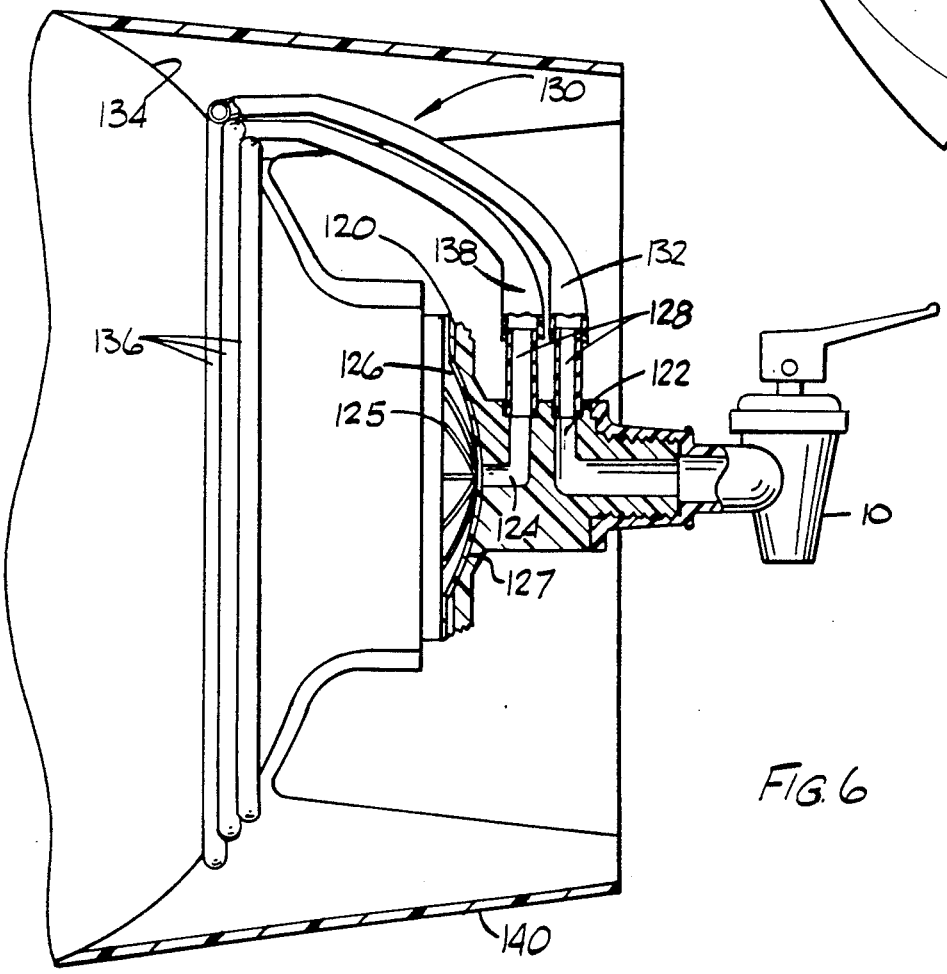
FIG. 6

FLOW CONTROL APPARATUS

FIELD OF THE INVENTION

This invention relates to the marketing of various types of liquids wherein the liquid is contained in a container under a relatively high pressure and more particularly to dispensing apparatus for dispensing the liquid in relatively small increments at a relatively low pressure while maintaining the relatively high pressure in the container.

BACKGROUND OF THE INVENTION

It is known to market liquids, such as beer or other beverages, in containers wherein the liquid is maintained under relatively high pressure. It is desirable to be able to permit the partial dispensing of the liquids at a relatively low pressure while maintaining the relatively high pressure in the container. This is accomplished by a flow regulating apparatus which reduces the pressure on the liquid prior to its being dispensed so as to prevent undue foaming of the liquid. In U.S. Pat. Nos. 2,899,170; 2,924,238; 3,863,673; 4,078,578 and 4,739,901, there are disclosed several differing types of liquid dispensing apparatuses for reducing the pressure on the liquid so that it can be properly dispensed from a container. In U.S. Pat. No. 4,353,488, there is disclosed means for opening a container so that the material confined therein may be dispensed. In U.S. Pat. No. 4,867,348, there is disclosed a disposable container for marketing beer in quantities equal to two hundred and eighty-eight liquid ounces. One problem associated with this concept is the necessity for an economical dispensing apparatus for dispensing the beer at the right pressure and flow rate. This invention provides economical flow control apparatus so that the beer being dispensed from a dispensing valve member is at the right pressure, flow rate and foam height.

BRIEF DESCRIPTION OF THE INVENTION

This invention provides flow control apparatus located between the liquid contained in a container under relatively high pressure and a dispensing valve member from which the liquid is dispensed so that the liquid being dispensed by the dispensing valve member is at the desired pressure, flow rate and foam height.

In one preferred embodiment of the invention, a flow control apparatus is provided for reducing the pressure on a liquid as it flows from the container to the dispensing valve member. The flow control apparatus comprises a hollow housing, a hollow core member and a flow regulator assembled together to form one unit. The flow control apparatus is provided with attaching means so that a dispensing valve member may be attached thereto. The hollow housing has a main body portion having the valve member attaching means located on one side thereof. An integral annular flange portion projects outwardly from the other side of the main body portion and is used to attach the main body portion in an opening leading from the container. A hollow core member is provided and has an integral front end portion mounted in the main body portion and an integral back end portion projecting into the container. The front end portion has cylindrical inner and outer surfaces. The back end portion has a cylindrical inner surface that is a continuation of the cylindrical inner surface of the front end portion and a conical inner surface. An opening in the back end portion is in liquid communication with to the liquid in the container. A flow regulator is provided and has an outer surface having a cylindrical portion facing the cylindrical inner surface of the back end portion, a conical portion facing the conical inner surface and a conical surface facing the cylindrical inner surface of the front end portion. Spacing means are provided so that the outer surfaces are spaced from the inner surfaces so that the liquid from the container may flow through the spaced relationship and the hollow housing to a dispensing valve member. As the liquid flows through the spaced relationship, the pressure on the liquid is reduced. The hollow housing, the hollow core member and the flow regulator are mounted together so as to prevent any relative movement therebetween and are each integrally molded using a relatively rigid plastic material, such as polycarbonate, polypropylene or other materials having similar characteristics.

In another preferred embodiment of the invention, the flow control apparatus comprises an annular member secured on the open end of a container having liquid under pressure contained therein and having a dispensing valve member secured thereon. A continuous hollow tube formed into a plurality of coils is mounted on the inside or the outside of the container. The hollow tube has one end in liquid communication with the liquid in the container and the other end in liquid communication with the dispensing valve means. When the hollow tube is outside the container, it is within a protective housing.

The invention further provides preferred embodiments of securing means for applying a flow control apparatus on a container having at least one opening formed therein. Closure means are mounted on the container to close the opening. The closure means has a passageway extending therethrough and the inner end of the passageway is sealed by a displaceable sealing member. Flow control apparatus is attached to the closure means and has a portion thereon which is located to pass through the passageway and displace the displaceable sealing member and open the passageway. A dispensing valve member is secured on the flow control apparatus.

BRIEF DESCRIPTION OF THE DRAWINGS

Illustrative and presently preferred embodiments of the invention are shown in the accompanying drawings in which:

FIG. 5 is a side elevational view with parts in section of another embodiment of the invention;

FIG. 6 is a side elevational view with parts in section of another embodiment of the invention;

DETAILED DESCRIPTION OF THE INVENTION

Figure 1:
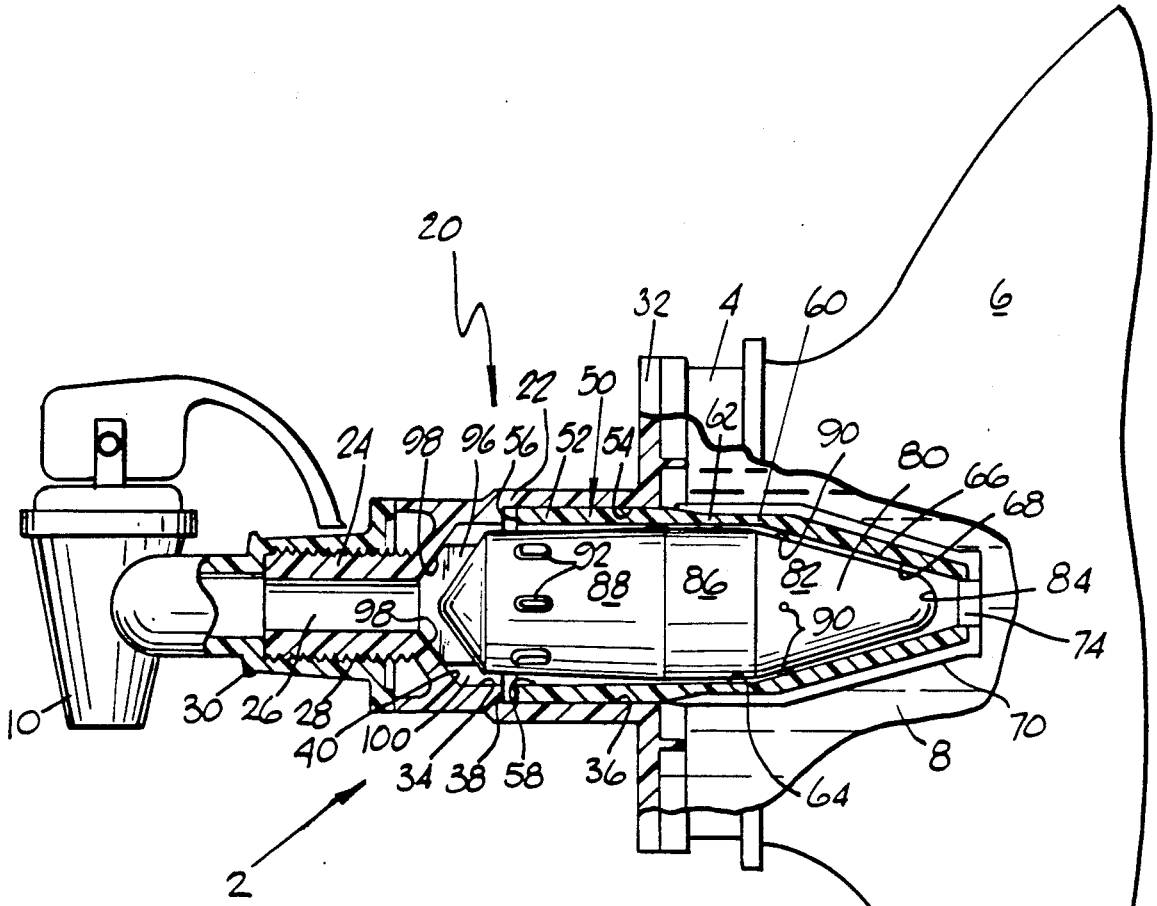
FIG. 1 is a side elevational view with parts in section of a flow control apparatus of one embodiment of this invention.
Figure 4:
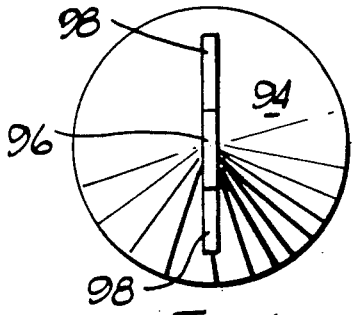
FIG. 4 is a front elevational view of FIG. 3.
Figure 2:
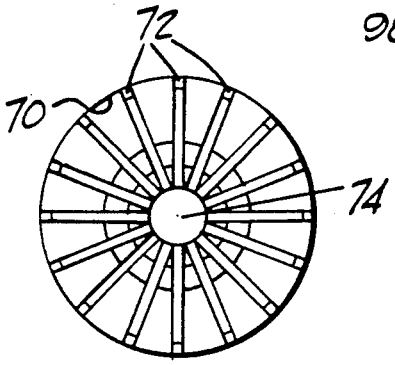
FIG. 2 is an end elevational view of the hollow core member of FIG. 1.
Figure 3:
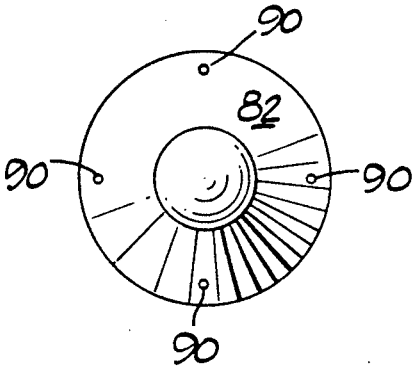
FIG. 3 is an end elevational view of the flow regulator of FIG. 1.

In FIG. 1, there is illustrated a preferred embodiment of the invention and which comprises flow control apparatus 2 mounted on the open end 4 of a container 6 having a liquid 8, such as a beverage such as beer or a soft drink, under relatively high pressure contained therein. The flow control apparatus 2 functions to reduce the pressure acting on the liquid 8 so that it may be dispensed by a dispensing valve member 10 mounted on the flow control apparatus 2 at the desired relatively low pressure.

The flow control apparatus 2 has a hollow housing 20 having a main body portion 22 and an integral dispensing valve member attaching portion 24 located on one side thereof. The attaching portion 24 has a passageway 26 extending therethrough and is provided with external threads 28 so that the portion 30 of the dispensing valve member 10 having the internal threads may be threaded thereon. The main body portion 20 has an integral annular flange portion 32 for securing the hollow housing 20 on the open end 4 of the container 6 by conventional means such as that disclosed in U.S. Pat. No. 4,867,348 which is incorporated herein by reference thereto. The main body portion 22 has an inner surface defined by two cylindrical surfaces 34 and 36 of different diameters so as to form a shoulder 38 for purposes described below. The main body portion 22 also has an inner conical surface 40 extending between the inner cylindrical surface 34 and the passageway 26.

The flow control apparatus also has a hollow core member 50 adapted to be mounted in the main body portion 22. The hollow core member 50 has a front end portion 52 having a cylindrical outer surface 54 having substantially the same diameter as the inner cylindrical surface 36 so as to have a force fit in the main body portion 22. The front end portion 52 has an end surface 56 that is spaced from the shoulder 38 to form an annular space therebetween and an inner cylindrical surface 58. The hollow core member 50 has a back end portion 60 projecting into the container 6. The back end portion has a continuous inner surface having a first part 62 having a cylindrical surface 64 having the same diameter as the cylindrical surface 58 and a second part 66 having an inner conical surface 68. The back end portion 60 has an outer surface 70 having a plurality of axially extending grooves 72 formed therein and which surround the open end 74, which is in liquid communication with the liquid 8 in the container 6. This is to ensure that a pressure applying pouch of the type in U.S. Pat. No. 4,867,348 will not block the flow of liquid 8 to the open end 74.

The flow control apparatus 2 also has a flow regulator 80 which is adapted to be mounted in the hollow core member 50 and the main body portion 22. The flow regulator 80 has a closed outer peripheral surface having a conical surface portion 82 having a closed end 84; a cylindrical surface portion 86 opposite to the cylindrical surface 64 and a slightly tapering conical surface portion 88. A plurality of circumferentially spaced apart protuberances 90 are formed on the conical surface portion 82 and are located so as to contact the conical surface 68 and form a space therebetween for the flow of the liquid 8. Another plurality of circumferentially spaced apart protuberances 92 are formed on the slightly tapering conical surface portion 88 and are located so as to contact the inner cylindrical surface 58 to form a space therebetween for the flow of the liquid 8. The flow regulator 80 has another end portion comprising a conical surface portion 94 and an integral relatively narrow vane 96 having tapering surface portions 98 which are adapted to contact the conical surface 40.

The flow control apparatus 2 is assembled by placing the flow regulator 80 in the hollow core member 50 so that the closed end 84 is next adjacent to the open end 74. The front end portion 52 is inserted into the main body portion 22 and moved inwardly until the tapering surface portions 98 contact the tapered surface 40. At the same time, the protuberances 90 will contact the conical surface 68 to form the desired space between the conical surface 68 and the conical surface portion 82. Also, the protuberances 92 will be in contact with the inner cylindrical surface 58. The inner cylindrical surface 36 and the outer cylindrical surface 54 are so dimensioned to have a force fit therebetween to prevent relative movement between the hollow housing, the hollow core member 50 and the flow regulator 80. As illustrated in FIG. 1, the cross-sectional area of the space or passageway between the flow regulator 80 and the hollow core member 50 is gradually increased from the open end 74 until the relatively large volume area 100 between the flow regulator 80 and the main body portion 22. As a result of the foregoing structure, the pressure of the liquid 8 leaving the dispensing valve member 10 is substantially less than the pressure on the liquid 8 at the open end 74.

In FIG. 5, there is illustrated another embodiment of a flow control apparatus comprising an annular member 110 secured to the open end 4 of a container 6 having liquid 8 under relatively high pressure contained therein. A dispensing valve member 10 is secured to the annular member 110 and has an elongated hollow tube 112 extending outwardly therefrom. The elongated hollow tube 112 is coiled so as to form a plurality of coils 114. The elongated hollow tube 112 has an open end portion 116 in liquid communication with the liquid 8 in the container 6. In operation, the liquid 8 will enter the open end portion 116 and flow through the coils 114. As the liquid 8 flows through the coils 114, the pressure on the liquid 8 is gradually reduced so that it exits from the dispensing valve member 10 at a pressure that is substantially less than the pressure on the liquid 8 at the open end portion 116. The hollow tube 112 can be formed of a relatively rigid material so that it can be formed in the coils 114 and remain in that position or it can be formed from a relatively flexible material and secured to each other and the annular member 110 by adhesive.

In FIG. 6, there is illustrated another embodiment of a flow control apparatus and comprises an annular member 120 secured to the open end 4 of a container 6 having liquid 8 under relatively high pressure contained therein. A dispensing valve member 10 is secured on the annular member 120 which is secured to the container 6 and has a first passageway 122 having an opening leading to the dispensing valve member 10 and an opening leading to atmosphere and a second passageway 124 having an opening leading to atmosphere and an opening in liquid communication with the container 6. A plurality of grooves 125 are formed in the inner surface 126 of the dome shaped end wall 127 to provide passageways for the flow of the liquid as the pressure applying pouch expands. A connecting member 128 is fitted into each of the openings to atmosphere. An elongated hollow tube 130 has one end portion 132 mounted on a connecting member 128 and is then coiled around a portion of the outer surface 134 of the container 6 to form a plurality of coils 136 and then the other end portion 138 is mounted on the other connecting member 128 to provide a passageway from the container 6 to the dispensing valve member 10. A protective cover 140, similar to that in U.S. Pat. No. 4,867,348, protects the coils 136. In operation, the liquid 8 will enter the hollow tube 126 and flow through the coils 136 and then to the dispensing valve member 10. As the liquid 8 flows through the coils 136, the pressure on the liquid 8 is gradually reduced so that it exits from the dispensing valve member 10 at a pressure that is substantially less than the pressure on the liquid 8 at the hollow tube 126.

In FIGS. 7–10, there is illustrated another embodiment of the invention using flow control apparatus 2 operating similarly to the flow control apparatus of FIG. 1. In this embodiment, a flow control apparatus 2, as described above, is secured on the open end 4 of a container 6 having liquid under relatively high pressure contained therein by connecting means 146. As described below, the connecting means 146 permits the flow control apparatus 2 to be removable and reusable. A flexible hose 148 is connected at one end portion 150 to the portion 30 having the internal threads and at the other end portion 152 to a dispensing valve member 10. The outer surface 70 does not have the grooves 72 formed therein. As illustrated by the dotted outline in FIG. 7, the flexible hose allows the dispensing valve member to be held in any position for the dispensing of liquid therefrom. Therefore, the container 6 may be in any position, vertical, horizontal or angled, and still have liquid dispensed therefrom.

Figure 8:
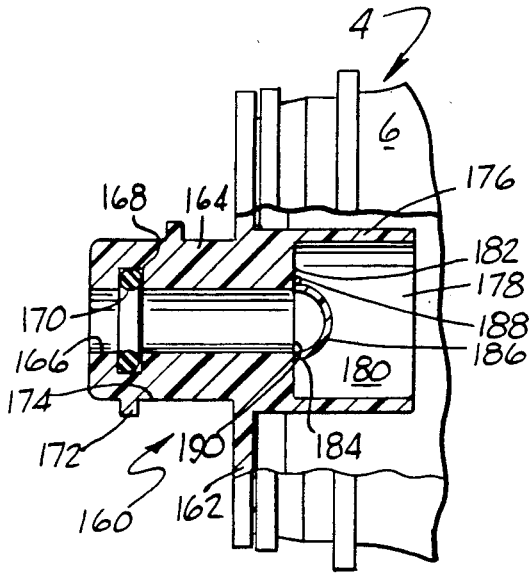
FIG. 8 is a side elevational view with parts in section of a closure means of FIG. 7 in a closed position.
Figure 9:
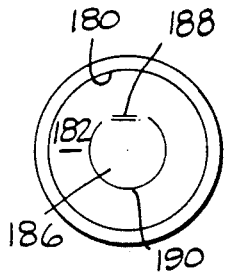
FIG. 9 is an end elevational view of the closure means of FIG. 8.
Figure 10:
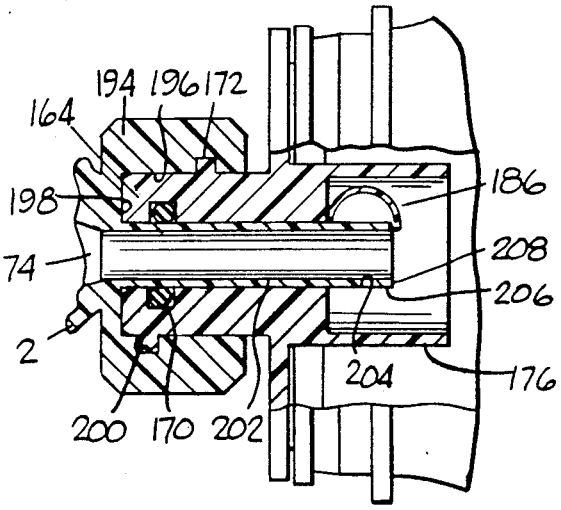
FIG. 10 is a side elevational view with parts in section of the flow control apparatus of FIG. 7 attached to the closure means and in an opened position.

The connecting means 146 for securing the flow control apparatus to a container is illustrated in FIGS. 8–10. A closure means 160 has an annular flange 162 for securing the closure means 160 to the open end 4 of the container 6 as described above. The closure means 160 has a front end portion 164 projecting outwardly away from the container and having a passageway 166 having a cylindrical inner surface extending therethrough. An annular groove 168 is formed in the passageway 166 and has an O-ring sealing gasket 170 seated therein. A spiral external thread 172 is formed on the outer surface 174 of the front end portion 164. The closure means 160 has a back end portion 176 projecting inwardly from the annular flange 162 and has a cavity 178 having a cylindrical sidewall 180 and an end wall 182. The passageway 166 has an open end 184. Displaceable sealing means are provided and comprise an integral dome shaped portion 186 with the outer surface thereof facing the fluid 8 in the container and having a hinge portion 188 that is thicker than the remaining portion 190 surrounding the open end 184 so that the dome shaped portion 186 will rupture along the remaining portion 190 when a force is applied thereto from the outside to form the opening 184 but be retained on the end wall 182 by the hinge portion 188. Other means may be employed to displaceably secure the dome shaped portion 186 on the end wall 182. The dome shaped portion 186 projects inwardly so as to withstand the pressure of the pressurized liquid 8 in the container.

The flow control apparatus 2, FIG. 10, has an integral connecting and displacing member 194 which has an internal cavity formed by a cylindrical sidewall 196 and an end wall 198. A spiral groove 200 is formed in the cylindrical sidewall 196 and is dimensioned to mate with the external thread 172 to connect the connecting and displacing member 194 to the closure means 160. A hollow displacing portion 202 projects outwardly from the end wall 198 toward the container 6 and has cylindrical inner 204 and outer 206 surfaces with the cylindrical outer surface 206 being dimensioned so that it can move through the passageway 166 and be in contact with the O-ring sealing gasket 170. In operation, the end portion 208 of the displacing portion 202 is inserted into the passageway 166 and the external thread 172 and the spiral groove 200 are brought together. As the connecting and displacing member 194 is rotated, the end portion 208 moves into contact with the dome shaped portion 186 and applies pressure thereto to rupture the remaining portion 190 and pivot the dome shaped portion 186 around the hinge portion 188 so that the end portion 208 is in liquid communication with the liquid 8 in the container 6 so that the liquid may move through the displacing portion 202 and the open end 74 into the flow control apparatus.

Figure 7:
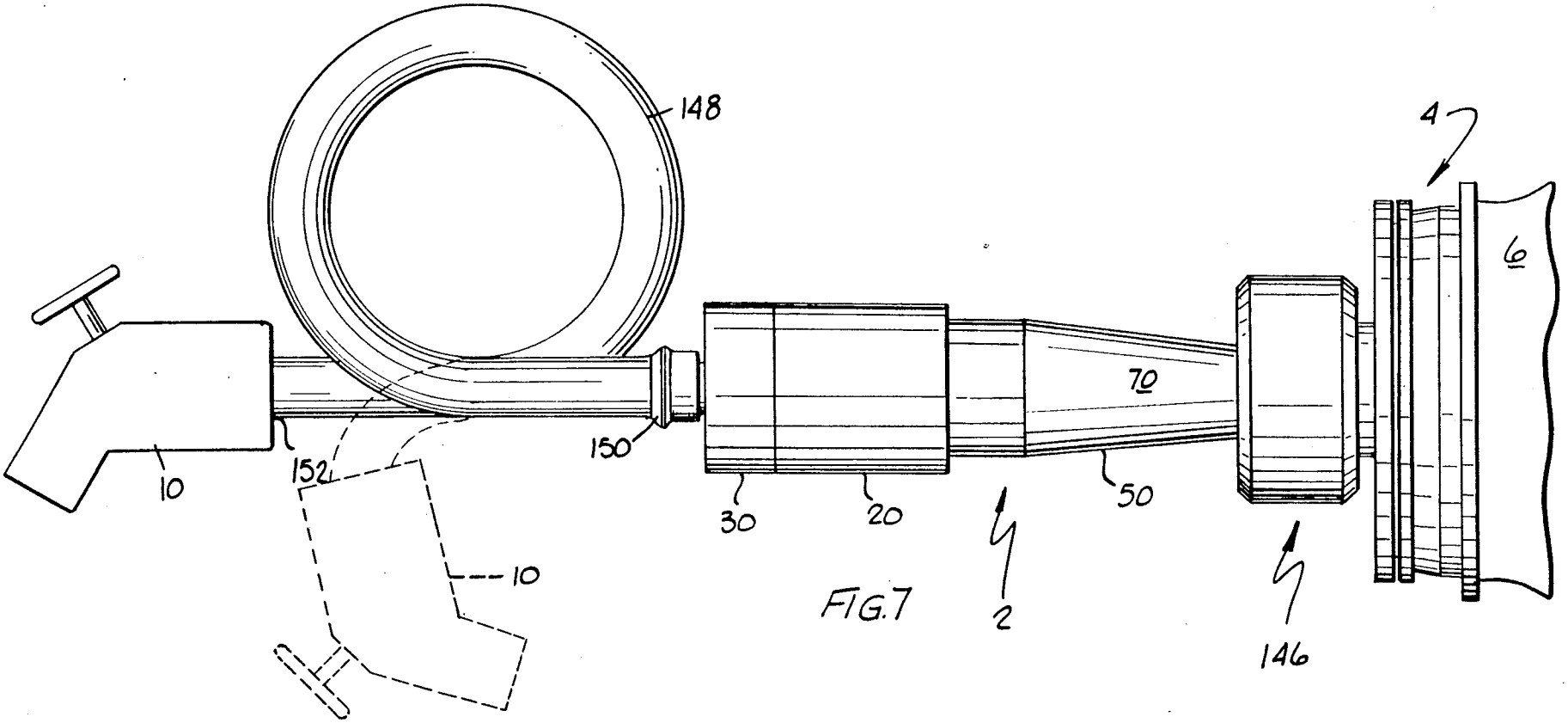
FIG. 7 is a side elevational view of another embodiment of the invention.
Figure 11:
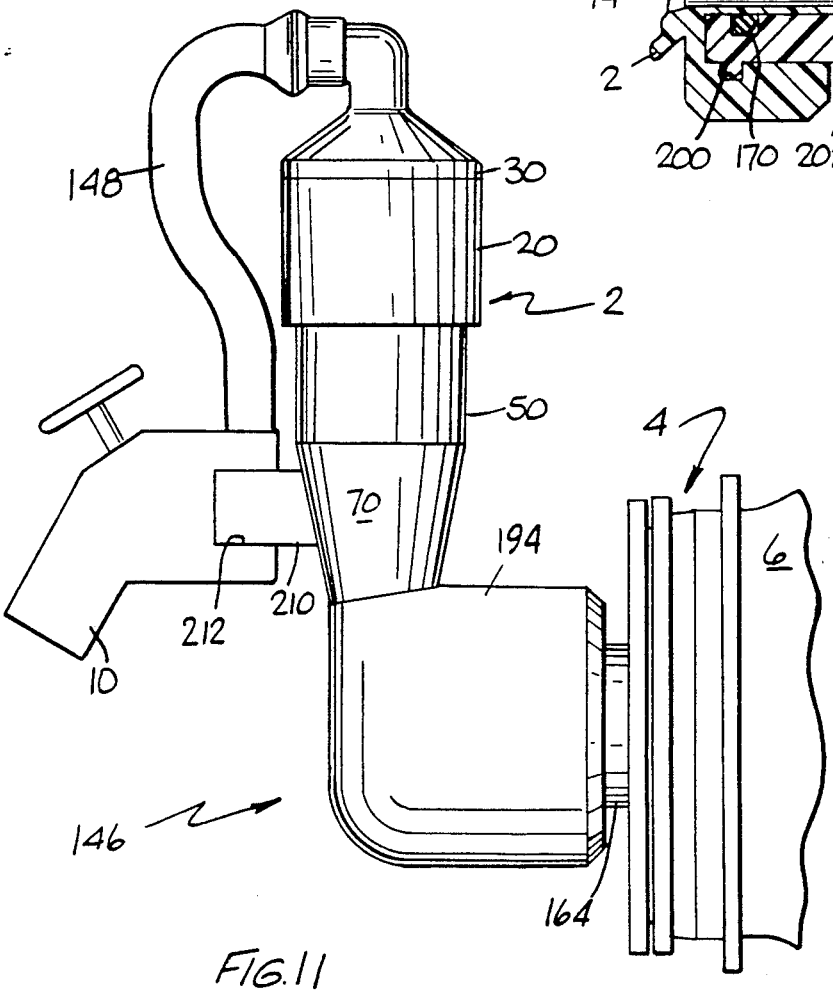
FIG. 11 is a side elevational view of another embodiment of the invention.

In FIG. 11, there is illustrated a modification of the flow control apparatus 2 of FIG. 7 wherein the connecting and displacing member 194 extends outwardly from the flow control apparatus 2 at a right angle thereto. The flow control apparatus 2 has a ledge 210 projecting outwardly therefrom and the dispensing valve member 10 has a recess 212 so that the dispensing valve member 10 may be positioned on the ledge 210 when not in use. The flexible hose 148 functions as described above.

Figure 12:
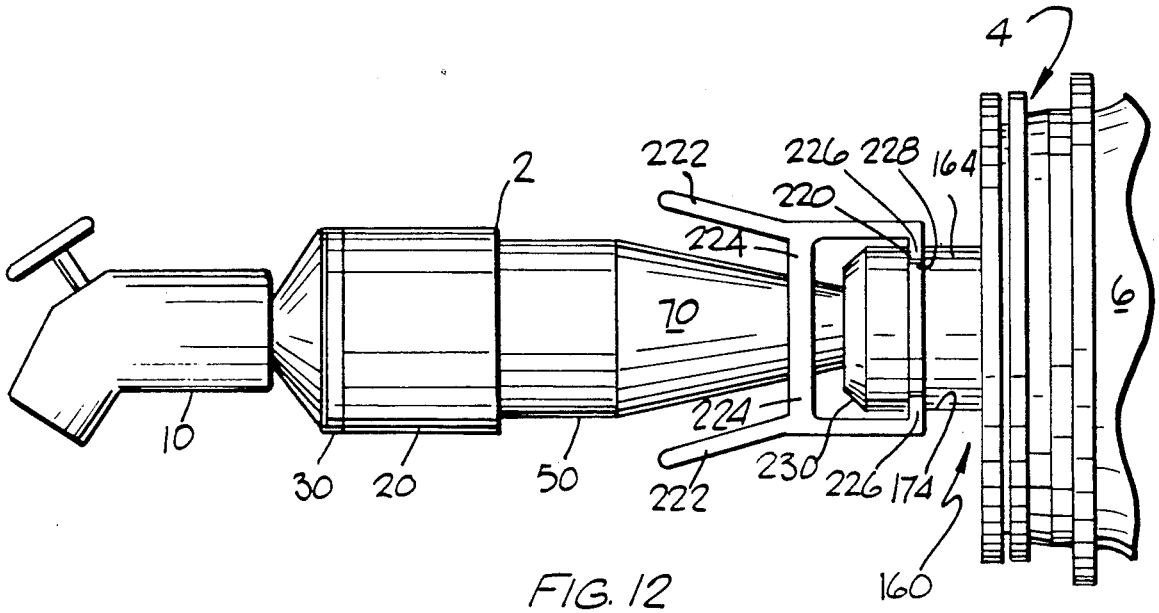
FIG. 12 is a side elevational view of another embodiment of the invention.

In FIG. 12, there is illustrated another means for connecting a flow control apparatus 2 to the open end 4 of a container 6 having a liquid under relatively high pressure contained therein. The front end portion 164 of the closure means 160 is provided with an annular groove 220 formed in its outer surface 174. A pair of levers 222 are integral with and connected to the flow control apparatus by pivot means 224. Hook portions 226 extend inwardly from the levers 222 and have arcuate surfaces 228 facing the annular groove 220 so as to mate therewith. The flow control apparatus 2 is assembled by pushing the hook portions 226 over the tapered surface 230 which will move the hook portions 226 away from each other. As the movement of the flow control apparatus 2 is continued, the displacing portion 202 thereof will contact and displace the dome shaped member 186 (not shown). Continued movement of the flow control apparatus 2 will permit the hook portions 226 to pivot into the annular groove 220 so as to hold the flow control apparatus 2 connected to the closure means 160.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Flow control apparatus for use in dispensing a liquid from a container at a relatively low pressure wherein the liquid in the container is under relatively high pressure comprising:

a hollow housing having a main body portion;

mounting means for mounting said hollow housing on said container so that said fluid may flow therethrough;

an integral valve attaching portion located on one side of said main body portion;

said integral valve attaching portion having a passageway extending therethrough for permitting said liquid to flow therethrough;

said main body portion having a generally cylindrical inner surface;

said main body portion having an abutment surface extending between said generally cylindrical inner surface and said passageway;

a dispensing valve member secured on said valve attaching portion;

a hollow core member having a front end portion mounted in said main body portion and an integral back end portion projecting toward said container;

said front end portion having a continuous cylindrical inner surface;

said back end portion having a continuous inner surface having a first part having a cylindrical surface having the same diameter as said cylindrical surface of said front end portion and a second part having a conical inner surface;

said back end portion having an open end to provide a passageway for said liquid in said container;

a flow regulator located within said hollow core member;

abutment means on said flow regulator for contacting said abutment surface of said main body portion;

said flow regulator having an outer surface having a cross-sectional configuration that is slightly smaller than facing portions of said continuous inner surfaces of said hollow core member;

said outer surface having a central portion that is cylindrical and an adjoining portion that is conical;

spacing means for providing a spaced relationship between said inner and outer surfaces for permitting the flow of said liquid from said container through said spaced relationship and said hollow housing to said valve member comprising a first plurality of circumferentially spaced apart protuberances projecting outwardly from said conical outer surface and in contact with portions of said conical inner surface; and a second plurality of circumferentially spaced apart protuberances projecting outwardly from said adjoining portion and in contact with portions of said cylindrical inner surface; and connecting means for connecting said hollow housing, said hollow core member and said flow regulator in a fixed relationship with said abutment means in contact with said abutment surface and said first plurality of circumferentially spaced apart protuberances in contact with said conical inner surface.

2. The invention as in claim 1 wherein:

said back end portion having a uniform thickness;

said back end portion having an outer surface having a plurality of spaced apart grooves formed therein; and said spaced apart grooves having major portions thereof which are axially extending and minor portions thereof which are radially extending and lead into said open end.

3. The invention as in claim 1 wherein said mounting means comprises:

an integral annular flange portion projecting outwardly from the other side of said main body portion for attaching said hollow housing to the container having said liquid under relatively high pressure contained therein.

4. The invention as in claim 1 wherein:

said hollow housing; said hollow core member and said flow regulator are each molded using a relatively rigid plastic material.

5. Flow control apparatus for use in dispensing a liquid from a container wherein the liquid in the container is under relatively high pressure comprising:

an annular member having outer and inner surfaces secured on an open end of a container having a liquid contained therein;

a dispensing valve member secured on said outer surface of said annular member and having at least one passageway formed therein and an opening facing into said container;

a continuous hollow tube in coil form having a plurality of coils; and said continuous tube having one end portion secured in said opening in said valve member and the other end portion opening into said container so that the pressure on said liquid is reduced as it flows through the coils.

6. The invention as in claim 5 wherein:

portions of said coils are secured to said annular member and other portions thereof are secured to each other.

7. Flow control apparatus for use in dispensing a liquid from a container wherein the liquid in the container is under relatively high pressure comprising:

an annular member secured on an open end of a container having a liquid contained therein;

a dispensing valve member secured on said annular member and having a body portion;

said body portion having a first passageway having an opening leading to said valve member and an opening leading to atmosphere and a second passageway having an opening leading to atmosphere and an opening leading to inside said container;

a hollow tube;

first connecting means for connecting said opening in said first passageway leading to atmosphere to one end of said hollow tube to provide liquid communication therebetween;

second connecting means for connecting said opening in said second passageway leading to atmosphere to the other end of said hollow tube to provide liquid communication therebetween; and the portion of said hollow tube between said one and other ends being coiled around a portion of the outer surface of said container to form a plurality of coils so that the pressure on said liquid is reduced as it flows through the coils.

8. The invention as in claim 7 and further comprising:

a protective cover on said outer surface of said container; and said coiled portion of said hollow tube being located between said protective cover and said outer surface of said container.

9. Apparatus for use in dispensing a liquid from a container comprising:

closure means secured on the open end of a container having a liquid contained therein for closing said open end;

said container having a longitudinal axis;

said closure means having a passageway extending therethrough;

displaceable sealing means for sealing one end of said passageway;

dispensing valve means connected to said closure means at the other end of said passageway;

said dispensing valve means having displacing means for displacing said sealing means;

attaching means for attaching said dispensing valve means so that said displacing means displaces said displaceable sealing means so that said passageway is opened when said dispensing valve means have been attached;

said liquid in said container being at a relatively high pressure;

flow control apparatus connecting said dispensing valve means to said body portion to reduce the pressure on said liquid as it passes through said flow control apparatus; and wherein said attaching means comprises:

said closure means having a body portion located outside of said container and having a cylindrical outer surface;

an annular groove formed in said cylindrical outer surface; and hook means on said flow control apparatus for insertion into said annular groove for holding said flow control apparatus on said body portion.

10. The invention as in claim 9 wherein said hook means comprises:

at least a pair of levers pivotally mounted on said valve means; and each of said levers having an arcuately shaped projection for fitting into said annular groove.

* * * * *